US005931593A

United States Patent [19]

Röder

[11] Patent Number: 5,931,593

[45] Date of Patent: Aug. 3, 1999

[54] RING-SHAPED ELEMENT

[75] Inventor: Georg Röder, Schwabach, Germany

[73] Assignee: Schwan-STABILO Cosmetics GmbH & Co., Heroldsberg, Germany

[21] Appl. No.: 09/011,766

[22] PCT Filed: Sep. 2, 1996

[86] PCT No.: PCT/DE96/01661

§ 371 Date: Feb. 16, 1998

§ 102(e) Date: Feb. 16, 1998

[87] PCT Pub. No.: WO97/12766

PCT Pub. Date: Apr. 10, 1997

[30] Foreign Application Priority Data

Sep. 29, 1995 [DE] Germany ..... 295 15 574 U

[51] Int. Cl.[6] ..... B43K 23/00

[52] U.S. Cl. ..... 401/98; 401/124

[58] Field of Search ..... 401/98, 124, 202, 401/243, 245, 246, 247; 200/565, 568, 569; 277/484, 648, 649, 566, 565, 529, 530, 562

[56] References Cited

U.S. PATENT DOCUMENTS 2,600,714 6/1952 Wenscott et al. ..... 277/648

FOREIGN PATENT DOCUMENTS

| | | | |
|---|---|---|---|
| 594902 | 3/1960 | Canada | 401/98 |
| 1271537 | 1/1962 | France . | |
| 2069910 | 9/1971 | France . | |
| 1056891 | 5/1959 | Germany . | |
| 1461598 | 1/1969 | Germany . | |
| 1561832 | 4/1970 | Germany . | |

OTHER PUBLICATIONS

French Patent No. 2.040.702 dated Jan. 22, 1971.

German Patent No. 1 027 559 dated Apr. 3, 1958.

British Patent No. 1,067,849 dated May 3, 1967.

*Primary Examiner*—David J. Walczak

*Attorney, Agent, or Firm*—Bachman & LaPointe, P.C.

[57] ABSTRACT

A ring element for mounting in a peripherally extending groove of a cylindrical portion of a first body, wherein the ring element (10) projects out of the groove and bears at the inside against a cylindrical portion of a second body which can be fitted onto the first body. The ring element (10) has at its outer peripheral surface (12) a number of raised portions (14). Associated with each outside raised portion (14) on the inner peripheral surface (16) are a pair of inside raised portions (18) which are disposed in symmetrically laterally displaced relationship with respect to the associated outside raised portion (14).

6 Claims, 1 Drawing Sheet

RING-SHAPED ELEMENT

The invention concerns a ring element for mounting in a peripherally extending groove of a cylindrical portion of a first body, wherein the ring element projects out of the groove and bears at the inside against a cylindrical portion of a second body which can be fitted onto the first body and removed from the first body, and wherein at its outer peripheral surface the ring element has a number of raised portions which are wequidistantally spaced from each other in the peripheral direction.

The first body is for example the casing stem of a cosmetic applicator or a part of such a casing stem such as a casing sleeve, a closure plug or the like. The second body is for example a closure cap of such a cosmetic applicator.

A ring element of the kind set forth in the opening part of this specification is known from German utility model No 18 02 121. That known ring element primarily concerns a clamping ring and less of a sealing ring. The inside peripheral surface in that known ring element is of a simple circular-cylindrical configuration. It is admittedly also described therein that the inside peripheral surface may also be provided with openings, but that publication gives no information as to how those inside openings are to be positioned in relation to the outer openings or raised portions.

DE 89 14 443 U1 discloses an applicator, in particular a cosmetic pencil, which has a stick in a casing. A closure cap can be fitted onto the casing to protect the stick or its application end portion which projects out of the casing. Provided between the casing and the cap is a sealing element in the form of an O-ring comprising an elastic material. Admittedly, with suitable dimensions, a ring element of that kind in the form of an O-ring affords a reliable sealing action as between the cap and the casing of the applicator, but when the cap is fitted onto the casing that involves compression of the air in the cap. In an extreme case that compression of the air can have the result that the cap is abruptly so-to-speak shot off the applicator casing. That applies also for example in relation to the cosmetic pencil which is known from DE 79 00 211 U1 and in which the closure cap is provided on the inside with a sealing element. That sealing element is also of a simple ring-like configuration. A clamping ring of a simple ring-like configuration for making a connection between the casing and the closure cap of a fountain pen, an ink recorder or the like is also known from DE 17 54 320 U1. That clamping ring of a simple ring-like configuration can be of an L-shaped cross-sectional profile, a U-shaped cross-sectional profile, a hollow profile or it may have spaced-apart laminate rings. As a result of the simply ring-shaped configuration this arrangement also provides that the clamping ring bears in peripherally uniform contact against the closure cap so that it is not possible to avoid compression of the air in the closure cap.

A ring element of the kind set forth in the opening part of this specification is also known from GB-A 1 067 849.

A vessel having a closure cap is known from German utility model No 18 75 459. The vessel and/or the closure cap has a peripherally extending groove which is provided for accommodating a sealing ring comprising an elastic material. The sealing ring is in the form of a simple ring so that the above considerations in regard to air exchange or air compression also apply in a corresponding fashion here.

FR-A 13 72 566 discloses a quick-action closure device having a ring element which is provided on its outer peripheral surface with raised portions. Those raised portions are adapted in terms of shape and in respect of their peripheral distribution to recesses provided on a member which is to be connected to a second member. This therefore involves a specific kind of bayonet locking arrangement. Air equalisation when making the connection, that is to say when the two members are fitted together, is not relevant here. The ring element also does not provide a sealing action but only a mechanical, positively locking connection.

Corresponding considerations also apply in regard to the sleeve portion with polygonal spring which is known from CH 626 834. That spring is intended only for resilient latching engagement, that is to say for making a mechanical connection between a writing implement and a sleeve portion. That spring does not provide for sealing integrity between the last-mentioned components.

German utility model No 1 982 313 discloses a writing implement with a clamping ring having radially outwardly projecting, resilient portions. Along those resilient portions the wall thickness of the clamping ring is less than along the remaining peripheral portions. Admittedly that clamping ring which comprises metal can produce a mechanical clamping action, but a sealing effect cannot be achieved with a clamping ring of that kind.

The object of the present invention is to provide a ring element of the kind set forth in the opening part of this specification, which provides an even, smooth but tight withdrawal and push-on characteristic, as between the first and second bodies, wherein at the same time while the second body is being fitted onto the first body air between them is in a position to produce an equalisation flow, and wherein a sealing action is afforded by the ring element in the fitted-on condition as between the two bodies.

In a ring element of the kind set forth in the opening part of this specification, in accordance with the invention, that object is attained in that associated with each outside raised portion on the inner peripheral surface are a pair of inside raised portions which are symmetrically laterally displaced with respect to the associated outside raised portion. A ring element of such a configuration advantageously affords a secure and well-operating clamping effect as between the first and second bodies and also the advantage of uniform withdrawal forces which result in a smooth and tight withdrawal characteristic for withdrawing the second body from the first body. In addition the ring element according to the invention is advantageously capable of compensating for mechanical manufacturing tolerances, by virtue of its limited resiliency characteristics which result from the out-of-roundness due to the outside and the inside raised portions. Furthermore the limited out-of-roundness of the ring element permits an air equalisation flow past the ring element during the fitting-on procedure so that particularly when the second body forms a closure cap, compression of the air in the closure cap is prevented when the closure cap is for example fitted onto the applicator stem which forms the first body. The above-described advantageous properties can possibly also be achieved if the ring element only has a single outside raised portion and a pair of associated inside raised portions.

Because the respective pair of inside raised portions are disposed in laterally displaced symmetrical relationship with respect to the associated outside raised portion, the same conditions in terms of fit-on or withdrawal characteristic or air-venting action respectively occur alternately in the peripheral direction of the ring element. It will be appreciated that that air-venting action occurs only during the operation of fitting the second body onto the first body, whereas in the fitted-on condition the ring element which is elastic in terms of its ring configuration and which is also elastic in itself, that is to say in its cross-section, then advantageously reliably seals off the connection between the first and the second bodies.

So that the outside and inside raised portions do not impede or adversely affect each other when the second body is being fitted onto the first body, it is possible to provide any number of outside raised portions. For example there may be three or six outside raised portions. They then include a respective angle of 120° or 60° respectively relative to each other.

A smooth and at the same time uniform tight withdrawal characteristic can be achieved if the outside raised portions and/or the inside raised portions are of axial dimensions which are smaller than the axial dimension of the ring element. The outside and inside raised portions may be for example of a knob-like or lens-like configuration or the like. In the case of a ring element of the last-mentioned kind the outside and the inside raised portions are preferably disposed axially centrally and are at least approximately of the same axial dimensions.

The ring element according to the invention preferably comprises an elastomer material. That elastomer material may be PP or PE. It will be appreciated that the ring element according to the invention may also comprise another suitable elastomer material.

Further details, features and advantages are apparent from the following description of an embodiment of the ring element according to the invention, which is shown on a greatly enlarged scale in the drawing in which.

Figure 1:
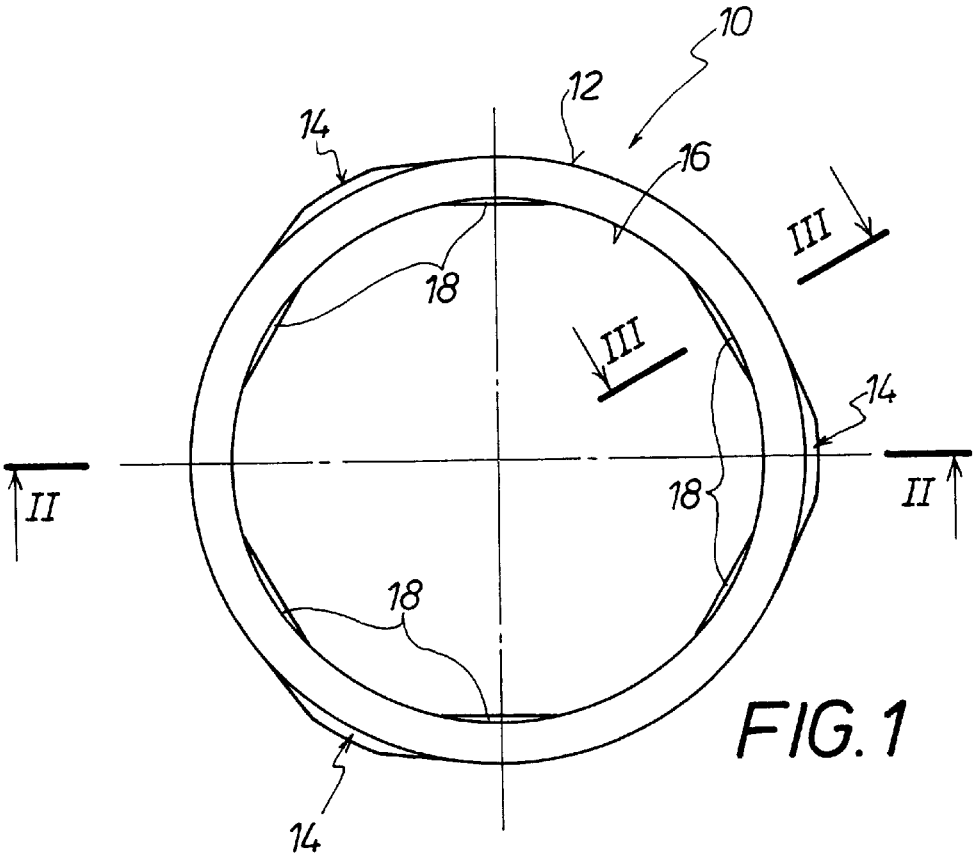
FIG. 1 is a view of the ring element from above.
Figure 2:
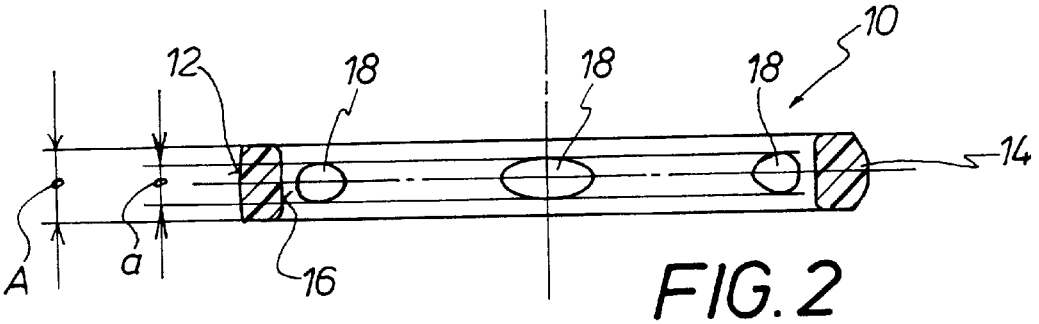
FIG. 2 is a view in section taken along section line II—II in FIG. 1 through the ring element.
Figure 3:
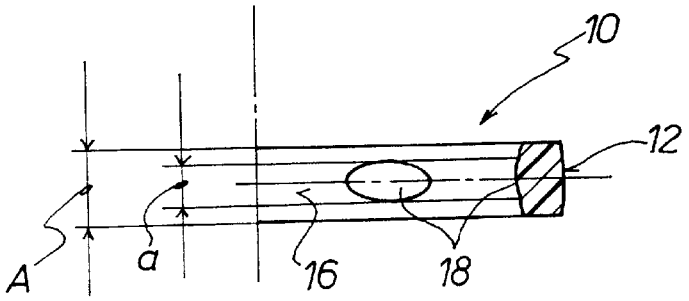
FIG. 3 is a view in section taken along section line III—III in FIG. 1.

FIGS. 1, 2 and 3 show a ring element 10 which has raised portions 14 at its outside peripheral surface 12. It will be seen from FIG. 1 that the ring element 10 has three outside raised portions 14 which are equidistantly spaced from each other in the peripheral direction of the ring element 10.

Associated with each outside raised portion 14, on the inner peripheral surface 16, are two inside raised portions 18. The inside raised portions 18 are spaced from each other and are symmetrically displaced with respect to the associated outside raised portion 14.

It will be seen from FIGS. 2 and 3 that the outside raised portions 14 and the inside raised portions 18 are of axial dimensions a which are smaller than the axial dimension A of the ring element 10. Last-mentioned FIGS. 2 and 3 also make it clear that the outside and inside raised portions 14 are disposed centrally in the axial direction of the ring element 10 and are of the same axial dimensions a.

I claim:

1. A ring element for mounting in a peripherally extending groove of a cylindrical portion of a first body, wherein the ring element (10) projects out of the groove and bears against a cylindrical portion of a second body which can be fitted onto the first body and removed from the first body, and wherein an outside peripheral surface (12) of the ring element (10) has a number of raised portions (14) which are equidistantly spaced from each other on the outside peripheral surface, characterized in that associated with each raised portion (14) are a pair of inside raised portions (18) on an inner peripheral surface of the ring element (16) which are disposed in symmetrically laterally displaced relationship with respect to the associated outside raised portion (14) whereby the number of inside raised portions is greater than the number of raised portions on the outside peripheral surface of the ring element.

2. A ring element as set forth in claim 1 characterized in that at least one of the outside raised portions (14) and the inside raised portions (18) are of axial dimensions (a) which is smaller than the axial dimension (A) of the ring element (10).

3. A ring element as set forth in claim 2 characterized in that the outside raised portions (14) and the inside raised portions (18) are at least approximately of the same axial dimensions (a).

4. A ring element as set forth in claim 1 characterized in that it the ring element comprises an elastomer material.

5. A ring element as set forth in claim 4 characterized in that the elastomer material comprises PP or PE.

6. A ring element as set forth in claim 1 characterized in that the number of inside raised portions is twice the number of the raised portions on the outside peripheral surface.

* * * * *